US007810210B2

(12) United States Patent
Yoo et al.

(10) Patent No.: US 7,810,210 B2
(45) Date of Patent: Oct. 12, 2010

(54) CLEANER HAVING A HANDLE FOR CARRYING A DUST CONTAINER AND A CLEANER BODY

(75) Inventors: Dong-hun Yoo, Gwangju (KR); Ji-won Seo, Gwangju (KR)

(73) Assignee: Samsung Gwangju Electronics Co. Ltd., Gwangju (KR)

( * ) Notice: Subject to any disclaimer, the term of this patent is extended or adjusted under 35 U.S.C. 154(b) by 31 days.

(21) Appl. No.: 12/151,877

(22) Filed: May 9, 2008

(65) Prior Publication Data

US 2009/0144930 A1 Jun. 11, 2009

(30) Foreign Application Priority Data

Dec. 5, 2007 (KR) ..... 10-2007-0125734

(51) Int. Cl.
*A47L 5/32* (2006.01)

(52) U.S. Cl. ..... 15/351; 15/335; 15/327.2

(58) Field of Classification Search ..... 15/350–353, 15/335, 327.2; *A47L 5/32, 9/16*
See application file for complete search history.

(56) References Cited

U.S. PATENT DOCUMENTS 6,385,810 B1 5/2002 Lang ..... 15/352
2006/0123589 A1* 6/2006 Kim ..... 15/352
2007/0209149 A1 9/2007 Lee

FOREIGN PATENT DOCUMENTS

| | | |
|---|---|---|
| EP | 1669015 | 6/2006 |
| GB | 2377881 | 1/2003 |
| KR | 1020020092563 | 12/2002 |
| KR | 1020060107629 | 10/2006 |
| KR | 1020060107630 | 10/2006 |

OTHER PUBLICATIONS

British Combined Search and Examination Report dated Dec. 4, 2008 corresponding to Application No. GB0814244.0.

* cited by examiner

*Primary Examiner*—David A Redding
(74) *Attorney, Agent, or Firm*—Ohlandt, Greeley, Ruggiero & Perle, LLP

(57) ABSTRACT

A cleaner is provided in which a handle for a dust receptacle can also be used as a handle for a cleaner body. The cleaner includes a cleaner body which includes a dust receptacle receiving unit, a dust receptacle which is detachably mounted on the dust receptacle receiving unit and includes a handle, a moving unit which moves the dust receptacle on the dust receptacle receiving unit to be fixed to the cleaner body, and a connection unit which fixes the dust receptacle to the cleaner body at two or more places according to the movement of the dust receptacle. Since the dust receptacle is firmly connected to the cleaner body by the connection unit, the handle can be used to carry the cleaner body as well as the dust receptacle.

13 Claims, 7 Drawing Sheets

CLEANER HAVING A HANDLE FOR CARRYING A DUST CONTAINER AND A CLEANER BODY

CROSS-REFERENCE TO RELATED APPLICATIONS

This application claims the benefit under 35 U.S.C. §119 of Korean Patent Application No. 10-2007-0125734, filed in the Korean Intellectual Property Office on Dec. 5, 2007, the entire disclosure of which is incorporated herein by reference.

BACKGROUND OF THE INVENTION

1. Field of the Invention

The present disclosure relates to a cleaner, and more particularly to a cleaner having a handle for carrying a dust container and a cleaner body.

2. Description of the Related Art

A general cleaner includes a cleaner body including a motor that generates a suction force, a brush that draws in dust-laden air, and a dust separation unit that separates dust from the air drawn in through the brush, collects the dust, and externally discharges the air from which dust has been thereby separated. The separated dust is collected in a dust receptacle.

If the cleaner is used for a long period of time, the dust receptacle may become full of dust and contaminants. In order to empty the dust receptacle, the dust receptacle is detachably mounted in the cleaner body. In general, the dust receptacle has a handle to be held by a user, so the user can detach the dust receptacle from the cleaner body and carry the dust receptacle to dump the collected dust.

In general, elasticity of a spring or a projectile is used to connect the dust receptacle to the cleaner body or disconnect the dust receptacle from the cleaner body, but such connections do not stand a heavy load. Therefore, a canister cleaner in which the cleaner body must be lifted and carried needs a separate handle for the cleaner body as well as a handle for the dust receptacle. That is, a general canister cleaner has a handle for the dust receptacle and a handle for the cleaner body separately. As a result, there is a problem of requiring additional process for manufacturing the handles and increasing the number of components. Furthermore, since a space for forming the handle for the cleaner body is needed, the entire volume of the cleaner increases and the degree of freedom in designing the exterior of the cleaner decreases.

SUMMARY OF THE INVENTION

An aspect of embodiments of the present disclosure is to solve at least the above problems and/or disadvantages and to provide at least the advantages described below. Accordingly, an aspect of embodiments of the present disclosure is to provide a cleaner in which a handle for a dust receptacle can also be used as a handle for a cleaner body so that the handle for the cleaner body is not needed separately.

In order to achieve the above-described and other aspects of embodiments of the present disclosure, a cleaner is provided including a cleaner body that comprises a dust receptacle receiving unit, a dust receptacle that is detachably mounted on the dust receptacle receiving unit and comprises a handle, a moving unit that moves the dust receptacle on the dust receptacle receiving unit to be fixed to the cleaner body, and a connection unit that fixes the dust receptacle to the cleaner body in two or more places according to the movement of the dust receptacle, wherein the handle of the dust receptacle is usable as a handle to carry the cleaner body.

The connection unit may include a first connection member that fixes a lower part of the dust receptacle to the cleaner body, and a second connection member that fixes an upper part of the dust receptacle to the cleaner body.

The first connection member may include a hook that is formed on the dust receptacle, and an eye that is formed on the cleaner body and in which the hook is connected.

The first connection member may include a rib that is formed on the dust receptacle, and a groove that is formed on the cleaner body to be connected to the rib.

The rib may include a first rib that has a ring shape and is formed around the circumference of the dust receptacle, and the groove may include a first groove that is connected to the first rib.

The rib may include a second rib that has a ring shape and is formed around the circumference of a dust inlet of the dust receptacle, and the groove may include a second groove that is connected to the second rib.

The second connection member may include a groove that is formed on the dust receptacle, and a rib that is formed on the cleaner body to be connected to the groove.

The groove may include a first groove that has a ring shape and is formed around the circumference of the dust receptacle, and the rib may include a first rib that is connected to the first groove.

The groove may include a second groove that has a ring shape and is formed around the circumference of the dust inlet of the dust receptacle, and the rib may include a second rib that is connected to the second groove.

The moving unit may include a rotation lever, a cam unit that converts rotary motion of the rotation lever into a reciprocating motion, and a moving plate that is in contact with one side of the dust receptacle and performs a reciprocating motion in association with the cam unit.

The dust receptacle may include a cover that is formed on the lower part of the dust receptacle to rotate about a hinge axis.

The dust receptacle may further include a cover fixing unit that fixes the cover to the dust receptacle, a cover releasing unit that releases the cover from the dust receptacle, and a button that operates the cover releasing unit.

The button may be formed on the handle.

The cover fixing unit may be formed on the cover, and include a hook that is formed of an elastic material, and an eye that is formed on the dust receptacle to receive the hook.

The cover releasing unit may release the cover from the dust receptacle by pressing one side of the hook.

In order to achieve the above-described and other aspects of embodiments of the present disclosure, a cleaner that can be used as upright and canister cleaners is provided, the cleaner including a brush assembly that draws in dust-laden air in contact with a cleaning surface, a cleaner body that is connected to the brush assembly through a suction hose, and comprises a dust receptacle receiving unit, a dust receptacle that is detachably mounted on the dust receptacle receiving unit and comprises a handle, a moving unit that moves the dust receptacle on the dust receptacle receiving unit to be fixed to the cleaner body, and a connection unit that fixes the dust receptacle to the cleaner body in two or more places according to the movement of the dust receptacle, so that the handle of the dust receptacle is able to be used as a handle to carry the cleaner body, and a support unit that supports the cleaner body to be detachably mounted on the brush assembly.

The brush assembly may include a brush that is in contact with the cleaning surface, and a suction pipe which is connected to the brush, and the supporting unit is formed on the suction pipe.

The supporting unit may include a locking unit that fixes the cleaner body to the suction pipe, and a receiving unit that receives a lower part of the cleaner body.

The cleaner may further include an upright handle that is formed on an upper part of the cleaner body to be gripped by a user when the cleaner is used as an upright cleaner.

BRIEF DESCRIPTION OF THE DRAWINGS

These and/or other aspects and advantages of the invention will become apparent and more readily appreciated from the following description and the accompanying drawings of which.

DETAILED DESCRIPTION OF EXEMPLARY EMBODIMENTS OF THE PRESENT DISCLOSURE

Figure 1:
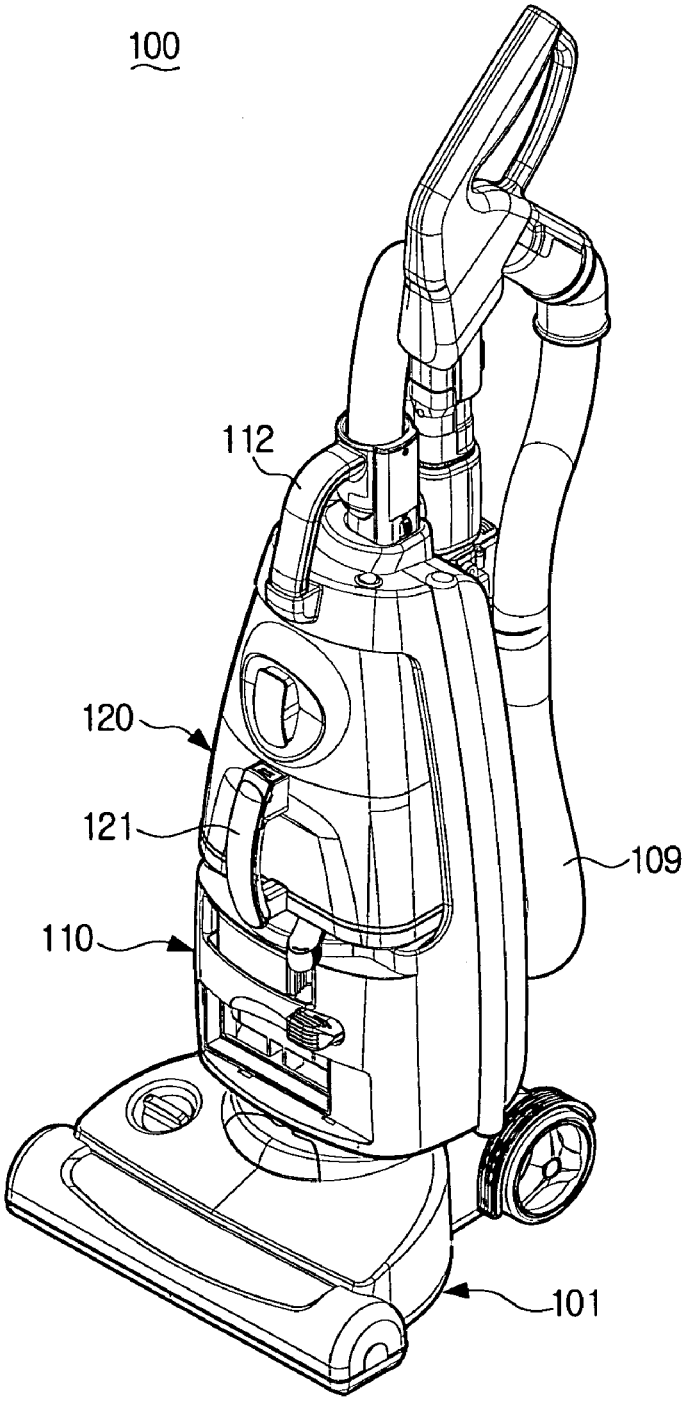
FIG. 1 is a perspective view illustrating a cleaner according to an exemplary embodiment of the present disclosure when the cleaner is used as an upright type.

Reference will now be made to the accompanying drawings, wherein like reference numerals refer to like elements throughout. The embodiments are described below in order to explain the present disclosure by referring to the figures.

Figure 2:
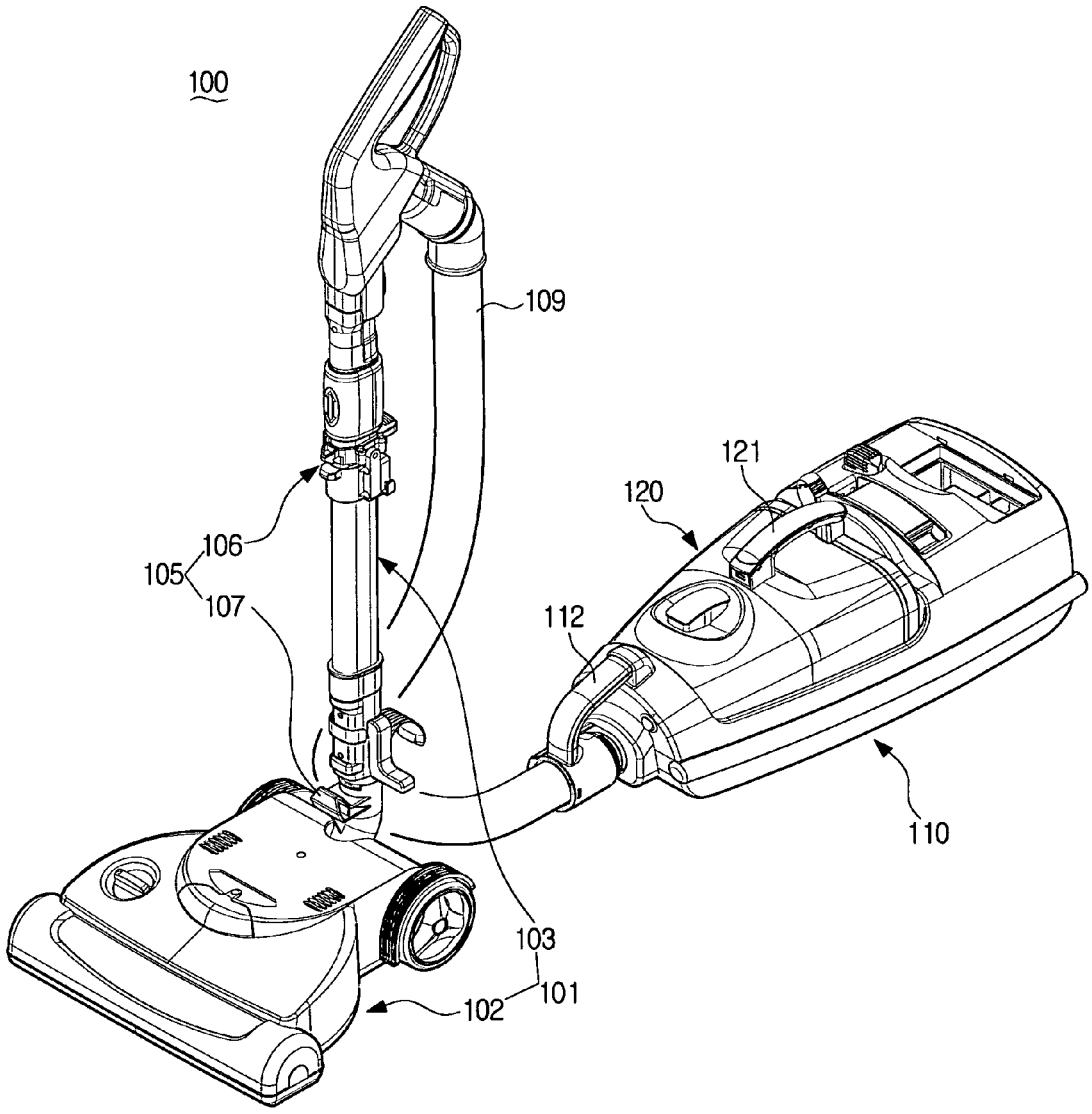
FIG. 2 is a perspective view illustrating the cleaner of FIG. 1 when the cleaner is used as a canister type.
Figure 3:
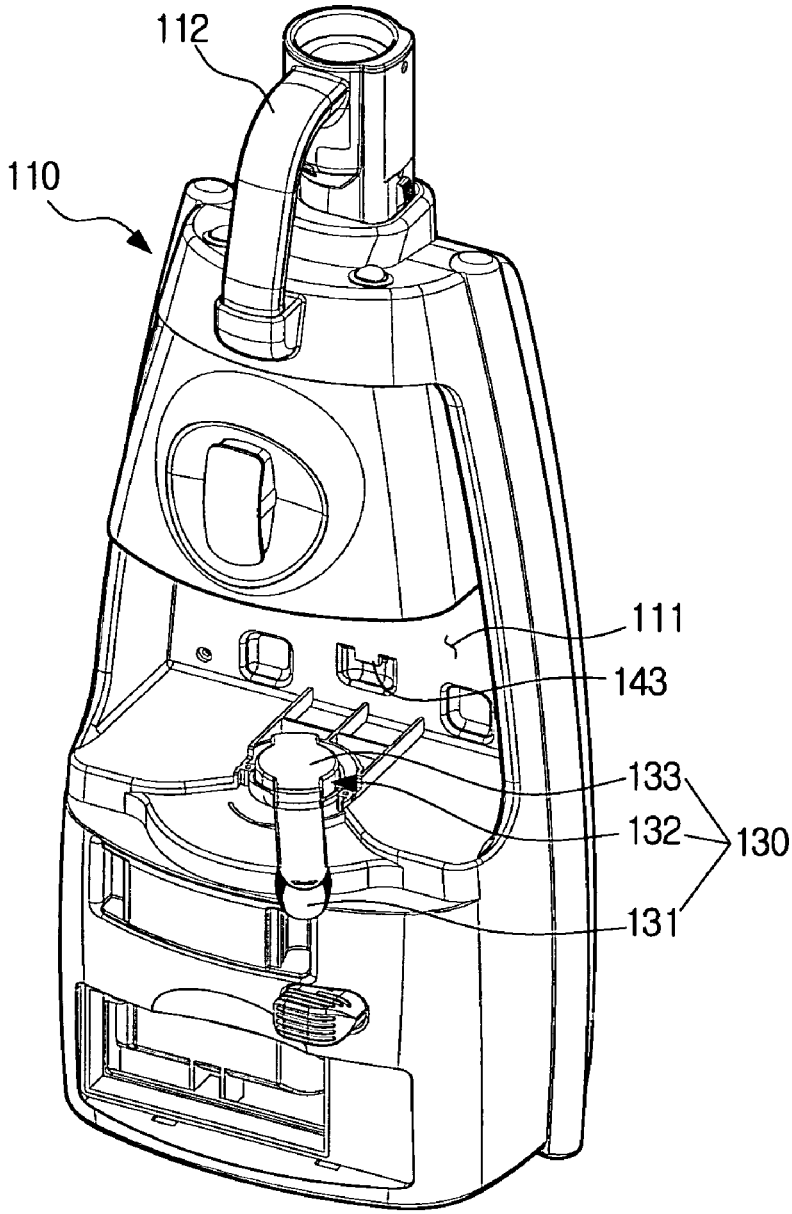
FIG. 3 is a perspective view illustrating a cleaner body according to an exemplary embodiment of the present disclosure.
Figure 4:
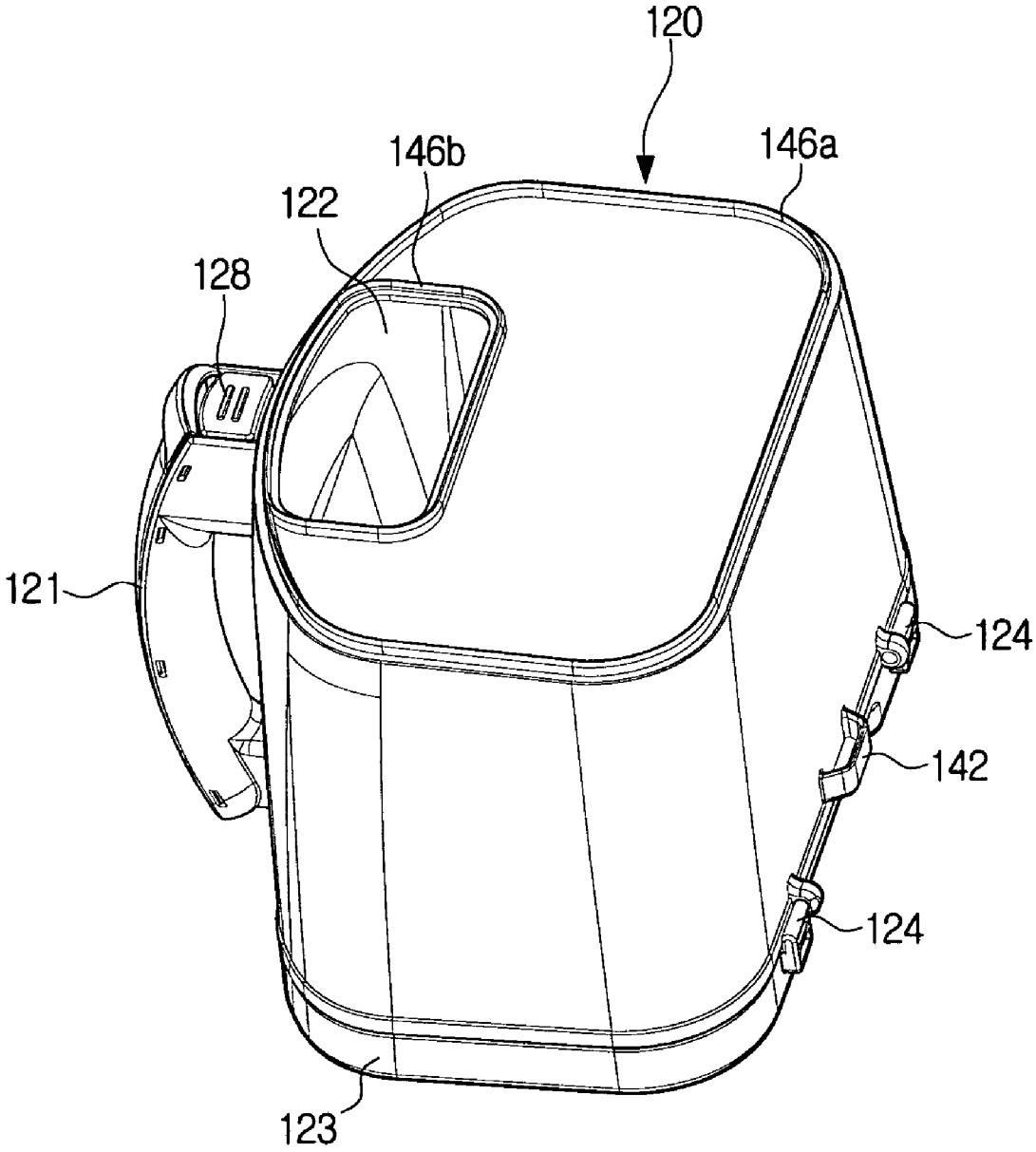
FIG. 4 is a perspective view illustrating a dust receptacle according to an exemplary embodiment of the present disclosure.
Figure 5:
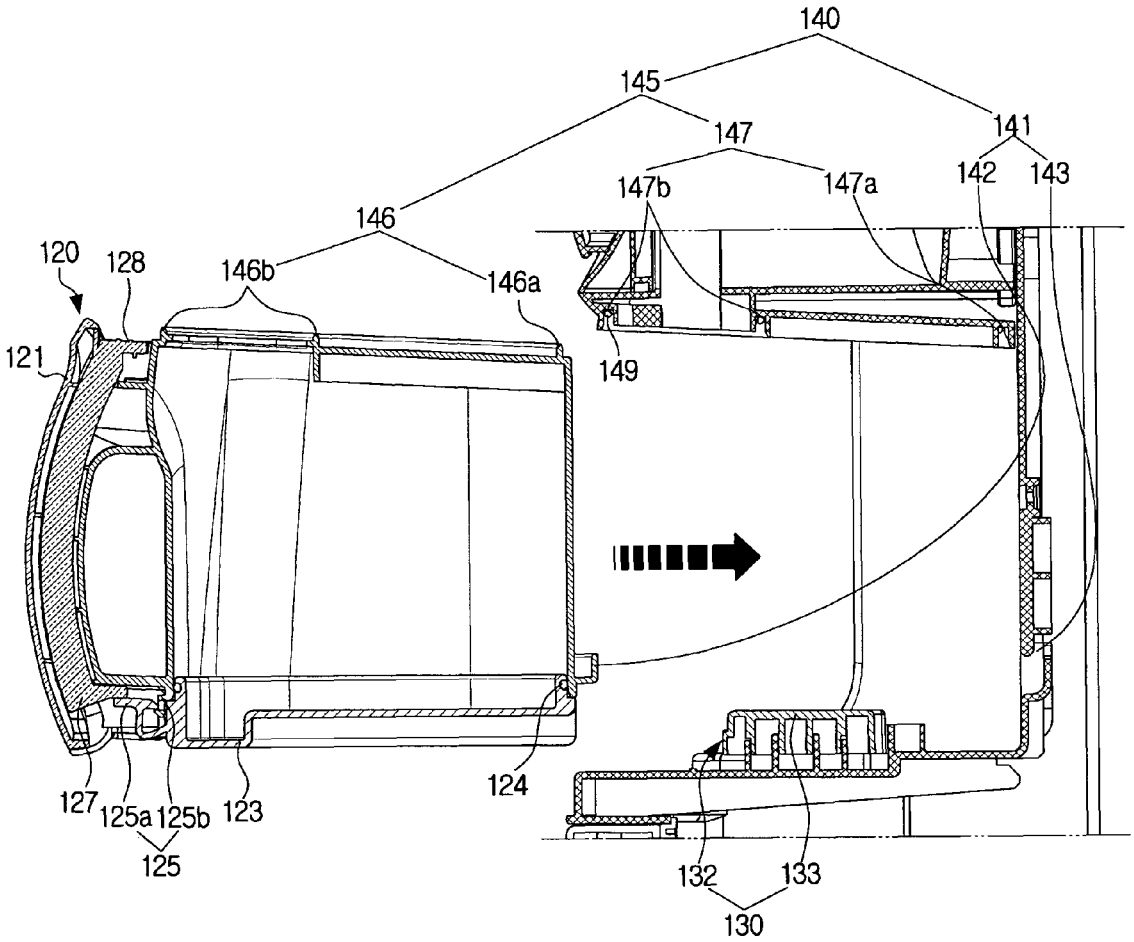
FIG. 5 is a cross-sectional view illustrating the dust receptacle of FIG. 3 and the cleaner body of FIG. 4.
Figure 6:
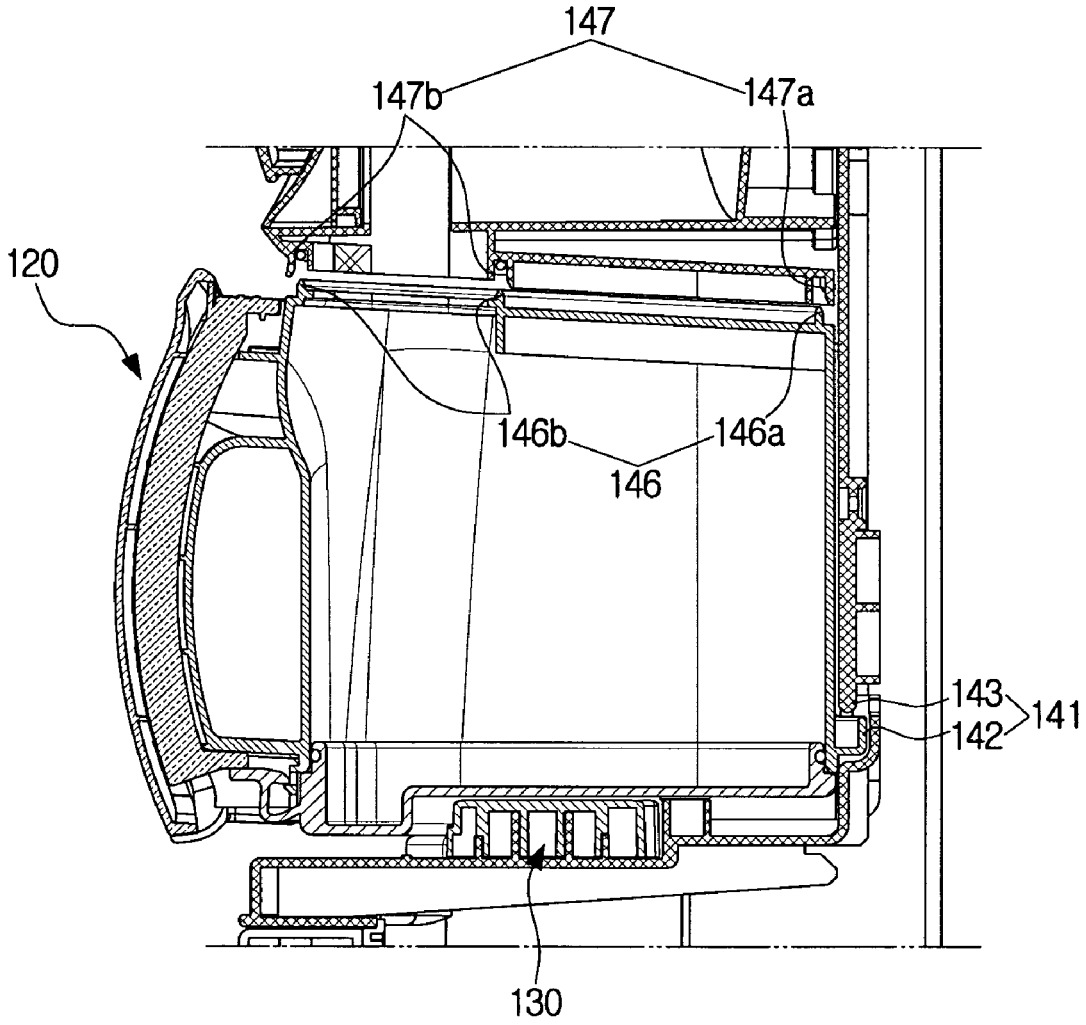
FIG. 6 is a cross-sectional view illustrating the dust receptacle and the cleaner body when the dust receptacle is mounted in the cleaner body but is not fixed to the cleaner body.
Figure 7:
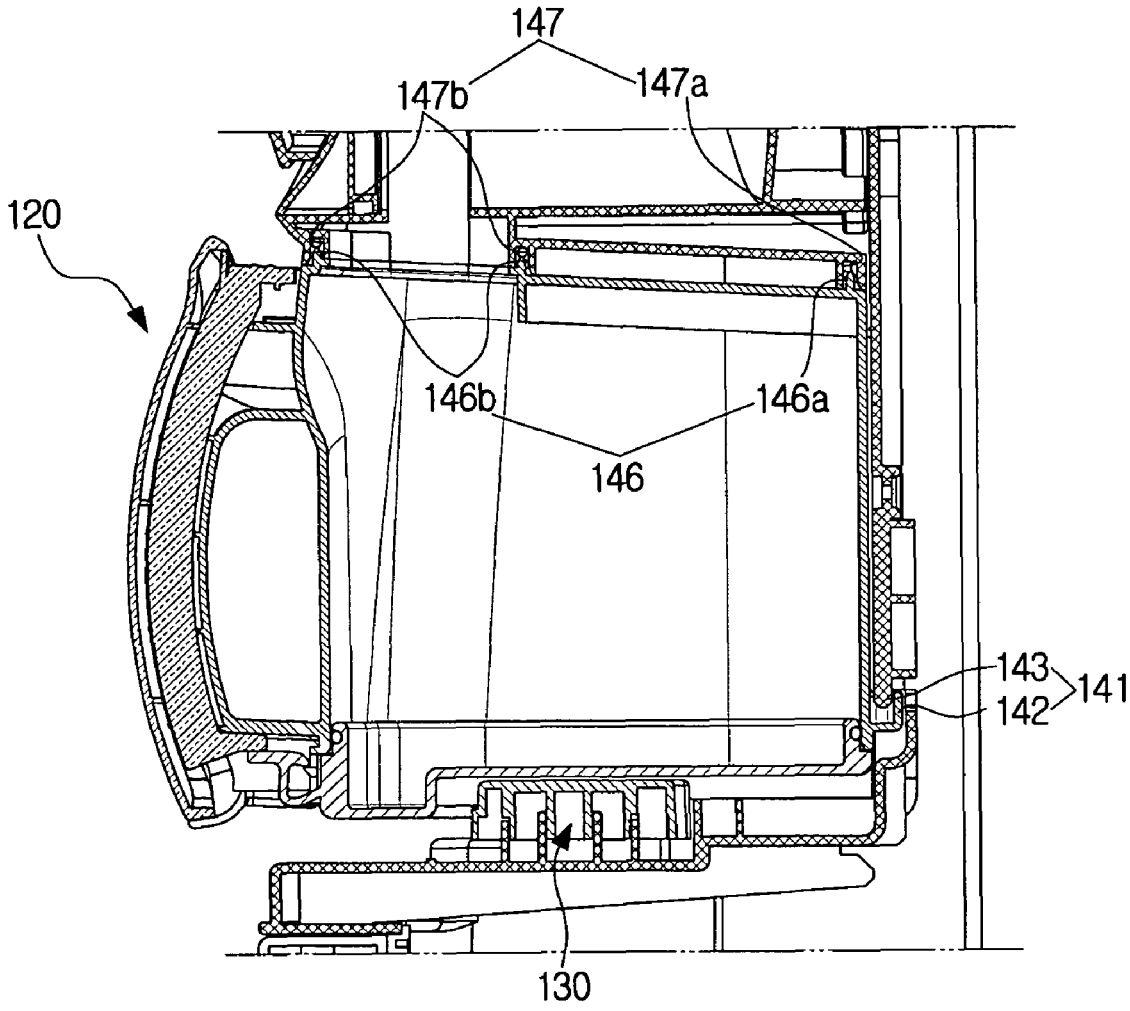
FIG. 7 is a cross-sectional view illustrating the dust receptacle and the cleaner body when the dust receptacle is fixed to the cleaner body.

FIG. 1 is a perspective view illustrating a cleaner 100, used as an upright type. FIG. 2 is a perspective view illustrating the cleaner 100 when the cleaner 100 is used as a canister type. FIG. 3 is a perspective view illustrating a cleaner body 110. FIG. 4 is a perspective view illustrating a dust receptacle 120. FIG. 5 is a cross-sectional view illustrating the dust receptacle 120 and the cleaner body 110. FIG. 6 is a cross-sectional view illustrating the dust receptacle 120 and the cleaner body 110 when the dust receptacle 120 is mounted in the cleaner body 110 but is not fixed to the cleaner body 110. FIG. 7 is a cross-sectional view illustrating the dust receptacle 120 and the cleaner body 110 when the dust receptacle 120 is fixed to the cleaner body.

With reference to FIGS. 1 to 5, the cleaner 100 includes a brush assembly 101, a support unit 105, a cleaner body 110, a dust receptacle 120, a moving unit 130, and a connection unit 140.

The brush assembly 101 is in contact with a surface to be cleaned, from which it draws dust-laden air. The brush assembly 101 includes a brush 102, and a suction pipe 103. The brush 102 is in contact with the surface to be cleaned and includes a roller in order for the user to conveniently clean the surface to be cleaned. The dust-laden air drawn into the brush 102 moves to the cleaner body 110 via the suction pipe 103. The suction pipe 103 is connected to the cleaner body 110 through a flexible suction hose 109.

The support unit 105 supports the cleaner body 110 to be detachably mounted on the brush assembly 101, and includes a locking unit 106, and a receiving unit 107. If the cleaner body 110 is mounted on the brush assembly 101 as shown in FIG. 1, the cleaner body 110 is fixed to the brush assembly 101 by the support unit 105. Consequently, the cleaner 100 can be used as an upright cleaner. If the cleaner body 110 is detached from the brush assembly 101 as shown in FIG. 2, the cleaner 100 can be used as a canister cleaner. In order to reduce the volume of the cleaner 100 and the number of components, the support unit 105 may be formed on the suction pipe 103.

The locking unit 106 detachably fixes the cleaner body 110 to the brush assembly 101, so diverse structures such as a hook can be used.

The receiving unit 107 receives a lower part of the cleaner body 110. When the cleaner body 110 is mounted on the brush assembly 101, the receiving unit 107 supports the cleaner body 110 so that the cleaner body 110 is not separated from the brush assembly 101 due to its weight.

The cleaner body 110 generates suction force to draw in dust-laden air, and separates dust from the air. That is, a motor (not shown) in the cleaner body 110 generates a suction force, and a dust collecting unit (not shown) in the cleaner body 110 separates dust from the air. The cleaner body 110 includes a dust receptacle receiving unit 111, and an upright handle 112.

The dust receptacle receiving unit 111 receives the dust receptacle 120 when the dust receptacle 120 is mounted in the cleaner body 110. The dust receptacle 120 may move a certain distance within the dust receptacle receiving unit 111, which will be described below.

The upright handle 112 is formed on an upper part of the cleaner body 110. If the cleaner 100 is used as an upright cleaner as shown in FIG. 1, the user can grip the upright handle 112. A handle 121 which is formed on the dust receptacle 120 and which will be described below can be used to grip the cleaner body 110. However, since the handle 121 is located at the center of the cleaner body 110 instead of being located on the upper part, it is convenient for the user to grip the upright handle 112 rather than the handle 121 when the cleaner 100 is used as an upright cleaner. When the cleaner 100 is used as a canister cleaner as shown in FIG. 2, the user grips the handle 121 on the dust receptacle 120 rather than the upright handle 112.

The dust receptacle 120 can be attached to or detached from the dust receptacle receiving unit 111 of the cleaner body 110, and collects dust separated by the dust separation unit in the cleaner body 110. The dust receptacle 120 includes a handle 121, a dust inlet 122, a cover 123, a cover fixing member 125, a cover releasing member 127, and a button 128. When the dust receptacle 120 is full of dust, the user may separate the dust receptacle 120 from the cleaner body 110, throw out the collected dust, and remount the dust receptacle 120 in the cleaner body 110.

The handle 121 is formed at the front surface of the dust receptacle 120 so that the user can grip the dust receptacle 120 conveniently. In a conventional cleaner, a handle which is formed on a dust receptacle is used to carry only the dust receptacle. However, since the dust receptacle 120 is firmly connected to the cleaner body 110 by the connection unit 140, the handle 121 on the dust receptacle 120 can be used to carry the cleaner body 110 as well as the dust receptacle 120. For example, when the cleaner 100 is used as a canister cleaner as shown in FIG. 2, the user can carry the cleaner body 110 by holding the handle 121 on the dust receptacle 120.

The dust separated by the dust separating unit of the cleaner body 110 enters the dust receptacle 120 through the dust inlet 122.

The cover 123 is formed on a lower part of the dust receptacle 120 so as to rotate about a hinge axis 124. Therefore, when the user empties the dust receptacle 120, he or she needs to only open the cover 123 without turning the dust receptacle 120 upside down. Consequently, the user can empty the dust receptacle 120 more conveniently.

With reference to FIG. 5, the cover fixing member 125 fixes the cover 123 to the dust receptacle 120. When the dust receptacle 120 is emptied and remounted in the cleaner body 110, the cover 123 must be fixed to the dust receptacle 120 by the cover fixing member 125. The cover fixing member 125 includes a hook 125*a*, and an eye 125*b*.

The hook 125*a* is formed on the cover 123 and is formed of an elastic material.

The eye 125*b* is formed on the dust receptacle 120, and receives the hook 125*a* at a location corresponding to the hook 125*a*. If the cover 123 rotates about the hinge axis 124 counterclockwise (as shown in FIGS. 4 and 5) to be fixed to the dust receptacle 120, the hook 125*a* hooks into the eye 126*b*. If the cover 123 rotates more, the elastic hook 125*a* is hooked in the eye 125*b* and the cover 123 is fixed to the dust receptacle 120.

The cover releasing member 127 releases the cover 123 from the cover fixing member 125. As shown in FIG. 5, if one side of the hook 125*a* is pressed downwards, the elastic hook 125*a* is released and the cover 123 is thereby opened.

The button 128 operates the cover releasing member 127 to release the cover 123. When the dust receptacle 120 is full of dust, the user carries the dust receptacle 120 using the handle 121 to dump it, and if the user presses the button 128, the cover releasing member 127 releases the cover 123 and the cover 123 is thus open. Accordingly, the button 128 is preferably formed on the handle 121 so that the user can easily press the button 128 while holding the handle 121 and can thus dump the dust conveniently.

The moving unit 130 moves the dust receptacle 120, which is mounted in the dust receptacle receiving unit 111, to be fixed to the cleaner body 110. The dust receptacle 120 is fixed to the cleaner body 110 in two or more places.

The moving unit 130 includes a rotation lever 131, a cam unit 132, and a moving plate 133, and is formed on a lower part of the dust receptacle receiving unit 111.

The rotation lever 131 rotates about an axis. If the user moves the rotation lever 131 right or left, the moving plate 132 moves upwards or downwards, and the dust receptacle 120 thus also moves upwards or downwards.

The cam unit 132 converts the rotary motion of the rotation lever 131 into a reciprocating motion. Since this operation of the cam unit 142 is well known to those skilled in the related art, detailed description is omitted here.

The moving plate 133 is in contact with one side of the dust receptacle 120, and performs a reciprocating motion in association with the cam unit 132. In this exemplary embodiment, the moving plate 133 is in contact with a lower surface of the dust receptacle 120, and moves the dust receptacle 120 upwards or downwards.

Such a structure of the moving unit 130 is merely an exemplary embodiment, and diverse structures of the moving unit 130 can be applied provided the dust receptacle 120 can move in the dust receptacle receiving unit 111.

The connection unit 140 connects the dust receptacle 120 to the cleaner body 110 in two or more places when the moving unit 130 moves the dust receptacle 120 to be fixed to the cleaner body 110. The connection unit 140 includes a first connection member 141, and a second connection member 145.

The first connection member 141 connects the lower part of the dust receptacle 120 to the cleaner body 110, and includes a hook 142 which is formed on the dust receptacle 120, and an eye 143 which is formed on the cleaner body 110 to correspond to the hook 142 and is thus connected to the hook 142. As shown in FIG. 6, the hook 142 is not connected to the eye 143 before the moving unit 130 moves the dust receptacle 120 upwards. As shown in FIG. 7, if the moving unit 130 moves the dust receptacle 120 upwards and the hook 142 is thus connected to the eye 143, the lower part of the dust receptacle 120 is fixed to the cleaner body 110.

In this exemplary embodiment, one hook 142 and one eye 143 are used, but this is merely an example. A plurality of hooks and eyes can be used at different locations. In addition, the first connection member can take diverse forms other than the hook and eye form.

The second connection member 145 connects the upper part of the dust receptacle 120 to the cleaner body 110, and includes a rib 146 and a groove 147.

The rib 146 is formed on an upper surface of the dust receptacle 120, and includes a first rib 146*a* which has a ring shape and is formed at the circumference of the dust receptacle 120, and a second rib 146*b* which has a ring shape and is formed at the circumference of the dust inlet 122 of the dust receptacle 120.

The groove 147 is formed on the cleaner body 110 to correspond to the rib 146 and be connected to the rib 146, and includes a first groove 147*a* which is connected to the first rib 146*a*, and a second groove 147*b* which is connected to the second rib 146*b*.

A sealing gasket 149 may be formed between the second rib 146*b* and the second groove 147*b* for sealing the dust inlet 122.

As shown in FIG. 6, the rib 146 is not connected to the groove 147 before the moving unit 130 moves the dust receptacle 120 upwards. As shown in FIG. 7, if the moving unit 130 moves the dust receptacle 120 upwards and thus the rib 146 is connected to the groove 147, the upper part of the dust receptacle 120 is fixed to the cleaner body 110.

As described above, the connection unit 140 connects the dust receptacle 120 to the cleaner body 110 in two or more places when the moving unit 130 moves the dust receptacle 120 to be fixed to the cleaner body 110. That is, the first connection member 141 is fixed to the lower part of the dust receptacle 110, and the second connection member 145 is fixed to the upper part of the dust receptacle 110. Since the upper part and lower part of the dust receptacle 120 are firmly connected to the cleaner body 110, the user can carry the cleaner body 110 by holding the handle 121 on the dust receptacle 120. For example, when the cleaner 100 is used as a canister cleaner as shown in FIG. 2, the user can clean and carry the cleaner body 110 using the handle 121 on the dust receptacle 120. Therefore, the present disclosure provides the advantage of not requiring a separate handle for carrying the cleaner body 110.

In the above exemplary embodiment, the rib 146 of the second connection member 145 is formed on the dust receptacle 120, and the groove 147 of the second connection member 145 is formed on the cleaner body 110. Alternatively, the rib 146 of the second connection member 145 may be formed on the cleaner body 110, and the groove 147 of the second connection member 145 may be formed on the dust receptacle 120.

In the cleaner 100 according to the exemplary embodiment of the present disclosure, a method for connecting the dust receptacle 120 to the cleaner body 110 is described.

As shown in FIG. 5, the user fixes the cover 123 to the dust receptacle 120. The user moves the moving plate 133 at the lowest location by moving the rotation lever 131. Subsequently, the user mounts the dust receptacle 120 on the dust receptacle receiving unit 111 by moving the dust receptacle 120 in the direction indicated by the arrow. This state is shown in FIG. 6, in which the dust receptacle 120 is not yet fixed to the cleaner body 110.

As the user moves the rotation lever 131, the moving plate 133 is raised and the dust receptacle 120 is thus raised. Consequently, the hook 142 is connected to the eye 143 on the lower part of the dust receptacle 120, and the first rib 146*a* and the second rib 146*b* are connected to the first groove 147*a* and the second groove 147*b*, respectively, on the upper part of the dust receptacle 120. The hook 142 and the eye 143 fix the lower part of the dust receptacle 120, and the first rib 146*a* and the first groove 147*a* fix the upper part of the dust receptacle 120. The second rib 146*b* and the second groove 147*b* seals dust entering the dust receptacle 120, and fix the dust receptacle 120 to the cleaner body 110. Since the dust receptacle 120 is firmly fixed to the cleaner body 110 in two or more places, the user can carry the cleaner body 110 by holding the handle 121 on the dust receptacle 120. For example, when the cleaner 100 is used as a canister cleaner as shown in FIG. 2, the user can carry the cleaner body 110 by holding the handle 121 on the dust receptacle 120.

If the dust receptacle 120 is full of dust, the user moves the moving plate 133 downwards by moving the rotation lever 131, and thus can throw dust away from the dust receptacle 120. Due to the cover 123 which is rotatably formed at the lower part of the dust receptacle 120 and the button 128 on the handle 121, the user can empty the dust receptacle 120 with ease.

In the exemplary embodiment, the dust receptacle 120 is mounted in the cleaner body 110 in the direction of the rear side of the dust receptacle 120, and the dust receptacle 120 is fixed to the cleaner body 110 by being moved upwards, but this is merely an example. The direction in which the dust receptacle 120 is mounted and fixed can vary according to the structure of the cleaner 100. For example, the dust receptacle 120 may be mounted in the direction of one side of the dust receptacle 120, and the dust receptacle 120 may be fixed to the cleaner body 110 by being moved downwards.

As can be appreciated from the above description, the handle for the dust receptacle and the handle for the cleaner body are not needed separately, so that the process of manufacturing the cleaner and the number of components can be reduced. Furthermore, the cleaner can be slim and thus the degree of freedom for designing appearance of the cleaner can increase.

While the invention has been shown and described with reference to certain embodiments thereof, it will be understood by those skilled in the art that various changes in form and details may be made therein without departing from the spirit and scope of the invention as defined by the appended claims.

What is claimed is:

1. A cleaner comprising:

a cleaner body which comprises a dust receptacle receiving unit;

a dust receptacle which is detachably mounted on the dust receptacle receiving unit and comprises a handle;

a moving unit which moves the dust receptacle on the dust receptacle receiving unit; and a connection unit which fixes the dust receptacle to the cleaner body in two or more places according to the movement of the dust receptacle, wherein the handle of the dust receptacle is usable to carry the cleaner body, wherein the connection unit comprises:

a first connection member which fixes a lower part of the dust receptacle to the cleaner body; and a second connection member which fixes an upper part of the dust receptacle to the cleaner body, wherein the second connection member comprises:

a rib member which is formed on the dust receptacle; and a groove member which is formed on the cleaner body to be connected to the rib, wherein:

the rib member comprises a first rib which has a ring shape and is formed circumferentially around the dust receptacle; and the groove member comprises a first groove which is connected to the first rib, wherein:

the rib member further comprises a second rib which has a ring shape and is formed circumferentially around a dust inlet of the dust receptacle; and the groove member further comprises a second groove which is connected to the second rib.

2. A cleaner comprising:

a cleaner body which comprises a dust receptacle receiving unit;

a dust receptacle which is detachably mounted on the dust receptacle receiving unit and comprises a handle;

a moving unit which moves the dust receptacle on the dust receptacle receiving unit; and a connection unit which fixes the dust receptacle to the cleaner body in two or more places according to the movement of the dust receptacle, wherein the handle of the dust receptacle is usable to carry the cleaner body, wherein the connection unit comprises:

a first connection member which fixes a lower part of the dust receptacle to the cleaner body; and a second connection member which fixes an upper part of the dust receptacle to the cleaner body, wherein the second connection member comprises:

a groove member which is formed on the dust receptacle; and a rib member which is formed on the cleaner body to be connected to the groove, wherein:

the groove member comprises a first groove which has a ring shape and is formed circumferentially around the dust receptacle; and the rib member comprises a first rib which is connected to the first groove.

3. The cleaner of claim 2, wherein:

the groove member further comprises a second groove which has a ring shape and is formed circumferentially around the dust inlet of the dust receptacle; and the rib member further comprises a second rib which is connected to the second groove.

4. A cleaner comprising:

a cleaner body which comprises a dust receptacle receiving unit;

a dust receptacle which is detachably mounted on the dust receptacle receiving unit and comprises a handle;

a moving unit which moves the dust receptacle on the dust receptacle receiving unit; and a connection unit which fixes the dust receptacle to the cleaner body in two or more places according to the movement of the dust receptacle, wherein the handle of the dust receptacle is usable to carry the cleaner body, wherein the dust receptacle comprises:

a cover which is formed on the lower part of the dust receptacle to rotate about a hinge axis.

5. The cleaner of claim 4, wherein the dust receptacle further comprises:

a cover fixing unit which fixes the cover to the dust receptacle;

a cover releasing unit which releases the cover from the dust receptacle; and a button which operates the cover releasing unit.

6. The cleaner of claim 5, wherein the button is formed on the handle.

7. The cleaner of claim 5, wherein:

the cover fixing unit is formed on the cover, and comprises:

a hook which is formed of an elastic material; and an eye which is formed on the dust receptacle to receive the hook.

8. The cleaner of claim 7, wherein:

the cover releasing unit releases the cover from the dust receptacle by pressing one side of the hook.

9. A cleaner comprising:

a brush assembly which draws in dust-laden air from a cleaning surface;

a cleaner body which is in fluid communication with the brush assembly, and comprises a dust receptacle receiving unit;

a dust receptacle which is detachably mounted on the dust receptacle receiving unit and comprises a handle;

a moving unit which moves the dust receptacle on the dust receptacle receiving unit to be fixed to the cleaner body; and a connection unit which fixes the dust receptacle to the cleaner body in two or more places according to the movement of the dust receptacle, so that the handle of the dust receptacle is useable to carry the cleaner body; and a support unit which supports the cleaner body to be detachably mounted on the brush assembly.

10. The cleaner of claim 9, wherein the brush assembly comprises:

a brush; and a suction pipe which is connected to the brush assembly, and the supporting unit is formed on the suction pipe.

11. The cleaner of claim 9, wherein the supporting unit comprises:

a locking unit which fixes the cleaner body to a suction pipe; and a receiving unit which receives a lower part of the cleaner body.

12. The cleaner of claim 9, further comprising an upright handle which is formed on an upper part of the cleaner body to be gripped by a user when the cleaner is used as an upright cleaner.

13. The cleaner of claim 9, wherein the cleaner is used as both upright cleaner and canister cleaner.

* * * * *